US005980074A

United States Patent [19]

Hwang

[11] Patent Number: 5,980,074

[45] Date of Patent: Nov. 9, 1999

[54] MOISTURE REMOVAL DEVICE FOR HEAD LAMP

[75] Inventor: Byeong Heui Hwang, Kyungki-do, Rep. of Korea

[73] Assignee: Hyundai Motor Company, Seoul, Rep. of Korea

[21] Appl. No.: 08/994,261

[22] Filed: Dec. 19, 1997

[30] Foreign Application Priority Data

Dec. 12, 1996 [KR] Rep. of Korea ..... 96-69669

[51] Int. Cl.[6] ..... F21V 29/00

[52] U.S. Cl. ..... 362/547; 362/294; 362/373

[58] Field of Search ..... 362/96, 267, 294, 362/373, 547

[56] References Cited

U.S. PATENT DOCUMENTS

| | | | |
|---|---|---|---|
| 3,593,017 | 7/1971 | Cibie | 362/547 |
| 4,796,163 | 1/1989 | Dressler | 362/294 |
| 5,116,326 | 5/1992 | Maglica | 362/267 |
| 5,251,111 | 10/1993 | Nagengast et al. | 362/294 |
| 5,536,019 | 7/1996 | Bryant et al. | 362/294 |
| 5,642,935 | 7/1997 | Schmitt | 362/294 |
| 5,775,794 | 7/1998 | Schmitt | 362/294 |

*Primary Examiner*—Alan Cariaso
*Attorney, Agent, or Firm*—Christie, Parker & Hale, LLP

[57] ABSTRACT

A device for removing moisture in a head lamp comprises a head lamp housing having an air vent hole; and an elastic valve member fixed to a wall portion of the head lamp housing, which defines the air vent hole, the elastic valve member having an exhaust valve for allowing air in the head lamp housing to be exhausted to an outside as a pressure of air in the head lamp housing is increased and an intake valve for allowing outside air to flow into the head lamp housing as the pressure of air in the head lamp housing is decreased.

10 Claims, 2 Drawing Sheets

MOISTURE REMOVAL DEVICE FOR HEAD LAMP

BACKGROUND OF THE INVENTION

1. Field of the Invention

The present invention relates to a device for removing moisture in a head lamp of an automobile, and more particularly to a device for removing moisture in a head lamp, which effectively removes moisture in a head lamp and at the same time, prevents outside moisture from flowing into the head lamp, and thereby increases an illumination intensity of the head lamp and enhances a valuableness of an automobile.

2. Description of the Related Art

A head lamp is an illuminating lamp which plays the important role of illuminating a way ahead, and is referred to as a front illuminating lamp. Generally, the head lamp must be able to afford recognition of an obstacle on a traffic way, which is positioned one hundred meters ahead, but standards for performance of a head lamp differ from country to country.

Referring to FIG. 1, there is illustrated a cross-sectional view schematically showing a general construction of a head lamp according to the prior art. The head lamp includes a head lamp housing 1. A lens 5 is fitted to a front end portion of the head lamp housing 1, which is opened to the outside. A bulb and a reflector (not shown) are provided in the head lamp housing 1. An air vent hole 2 is formed in a rear end wall of the head lamp housing 1 to exhaust heat generated in the head lamp housing 1 when the head lamp is turned on. A pipe portion 6 is integrally formed with the rear end wall of the head lamp housing 1, which defines the air vent hole 2, and an air tube 3 is fitted around the pipe portion 6. Accordingly, the heat generated in the head lamp housing 1 can be exhausted to the outside through the air tube 3. A sponge 4 is arranged in the course of the air tube 3. The sponge 4 prevents outside moisture from flowing into the head lamp housing 1.

However, in a structure of the head lamp constructed as mentioned above, although the sponge 4 is arranged in the course of the air tube 3 for preventing outside moisture from flowing into the head lamp housing 1, its effectiveness in shutting off the outside moisture is so flimsy that the outside moisture can still flow into the head lamp housing 1. Accordingly, the head lamp lens 5 can be frosted with the outside moisture, and thereby an illuminating intensity of the head lamp can be decreased.

SUMMARY OF THE INVENTION

Accordingly, the present invention has been made in an effort to solve the problems occurring in the related art, and an object of the present invention is to provide a device for removing moisture in a head lamp, which effectively removes moisture in a head lamp and at the same time, prevents outside moisture from flowing into the head lamp, and thereby increases an illumination intensity of the head lamp and enhances a valuableness of an automobile.

According to one aspect of the present invention, there is provided a device for removing moisture in a head lamp, comprising: a head lamp housing having an air vent hole; and an elastic valve member fixed to a wall portion of the head lamp housing, which defines the air vent hole, the elastic valve member having an exhaust valve for allowing air in the head lamp housing to be exhausted to an outside as a pressure of air in the head lamp housing is increased and an intake valve for allowing outside air to flow into the head lamp housing as the pressure of air in the head lamp housing is decreased.

According to another aspect of the present invention, a pipe portion is integrally formed with the wall portion of the head lamp housing, which defines the air vent hole, and the elastic valve member is fitted around an outer surface of the pipe portion.

According to another aspect of the present invention, a valve section of the elastic valve member, which is arranged in an air flowing path, has a shape that is curved toward the head lamp housing.

According to another aspect of the present invention, the intake valve is provided in substantially a center portion of the valve section of the elastic valve member, and the exhaust valve is provided in substantially an edge portion of the valve section of the elastic valve member.

According to another aspect of the present invention, a first depression is formed in a portion of the elastic valve member, which defines the intake valve, the first depression being depressed in a direction opposed to the head lamp housing and circumferentially extending; a plurality of air intake holes are formed in the first depression such that they are spaced from one another; and a pair of first elastic lips are formed in a portion of the elastic valve member, which defines a neck of the first depression, the pair of first elastic lips facing to each other while circumferentially extending and being capable of closing the plurality of air intake holes when engaged with each other.

According to another aspect of the present invention, a second depression is formed in a portion of the elastic valve member, which defines the exhaust valve, the second depression being depressed in a direction opposed to the head lamp housing and circumferentially extending; a plurality of air exhaust holes are formed in the second depression such that they are spaced from one another; and a second elastic lip is formed in a portion of the elastic valve member, which defines a neck of the second depression, the second elastic lip circumferentially extending and being capable of closing the plurality of air exhaust holes when engaged to an inner surface of the pipe portion.

According to another aspect of the present invention, the device further comprises a covering member having a cup-shaped configuration and fitted around an outer surface of the elastic valve member, the covering member having a grill formed in a bottom wall portion thereof.

According to another aspect of the present invention, the device further comprises a sponge attached to the bottom wall portion of the covering member.

According to still another aspect of the present invention, a pin portion is formed in a center portion of the bottom wall portion, the pin portion projectedly extending toward the head lamp housing to limit an amount of deformation of the elastic valve member; and a plurality of stoppers are formed on the outer surface of the pipe portion.

According to yet still another aspect of the present invention, the elastic valve member is made from rubber.

By the features of the present invention, when a pressure in a head lamp housing is elevated while the head lamp is turned on, an exhaust valve is opened to exhaust air in the head lamp housing to the outside, and when a pressure in the head lamp housing is lowered as the head lamp is turned off, an intake valve is opened to intake outside air into the head lamp housing. A space inside the head lamp housing is maintained in a tightly closed state while the head lamp is not used. Also, air which exhausted to the outside when the head lamp is turned on, vaporizes moisture formed in an inner surface of a pipe portion, and moisture contained in outside air flowing into the head lamp housing is removed by a heat of a portion of the intake valve. Therefore, since moisture in the head lamp is effectively exhausted and only a small amount of outside moisture can flow into the head lamp, the head lamp cannot be frosted with moisture, whereby an illumination intensity of the head lamp is increased and a valuableness of an automobile is enhanced.

BRIEF DESCRIPTION OF DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
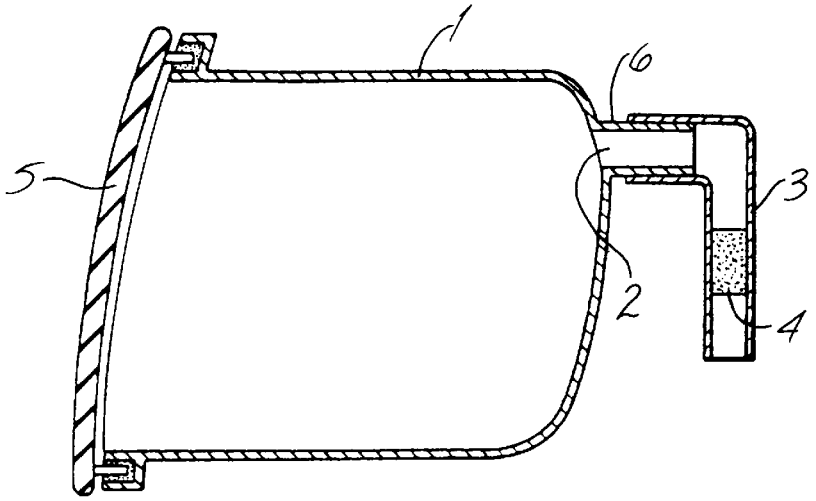
Fig. 1 PRIOR ART
FIG. 1 is a cross-sectional view schematically illustrating a general construction of a head lamp according to the prior art.

Reference will now be made in greater detail to a preferred embodiment of the invention, an example of which is illustrated in the accompanying drawings. Wherever possible, the same reference numerals will be used throughout the drawings to refer to the same or like parts.

Figure 2:
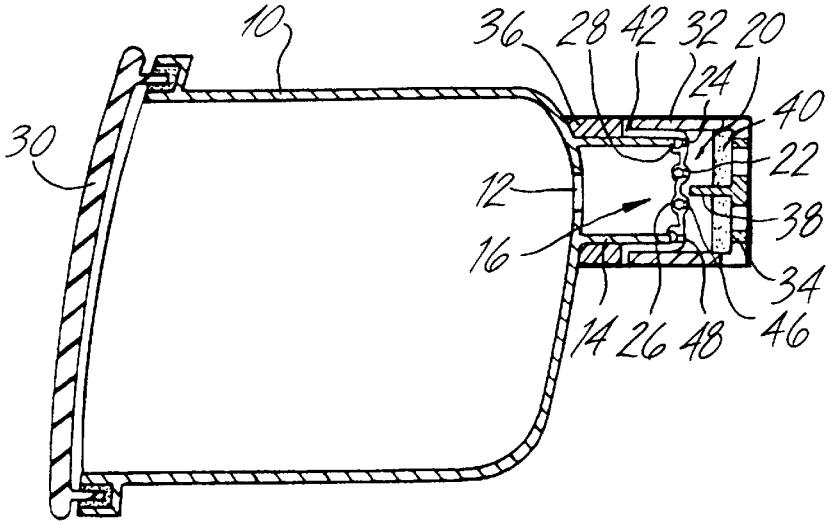
FIG. 2 is a cross-sectional view illustrating a construction of a device for removing moisture in a head lamp in accordance with an embodiment of the present invention.
Figure 3:
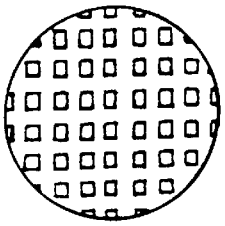
FIG. 3 is a front view showing an external appearance of a covering member used in the device for removing moisture in a head lamp of FIG. 2.
Figure 4:
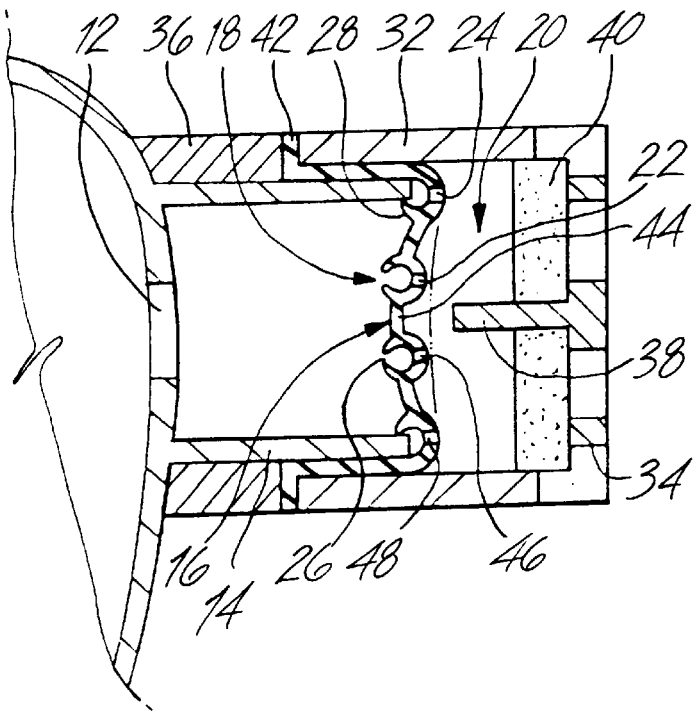
FIG. 4 is a cross-sectional view illustrating an exhaust mode of the device of the present invention, in which an elastic valve member is in an exhaust position.
Figure 5:
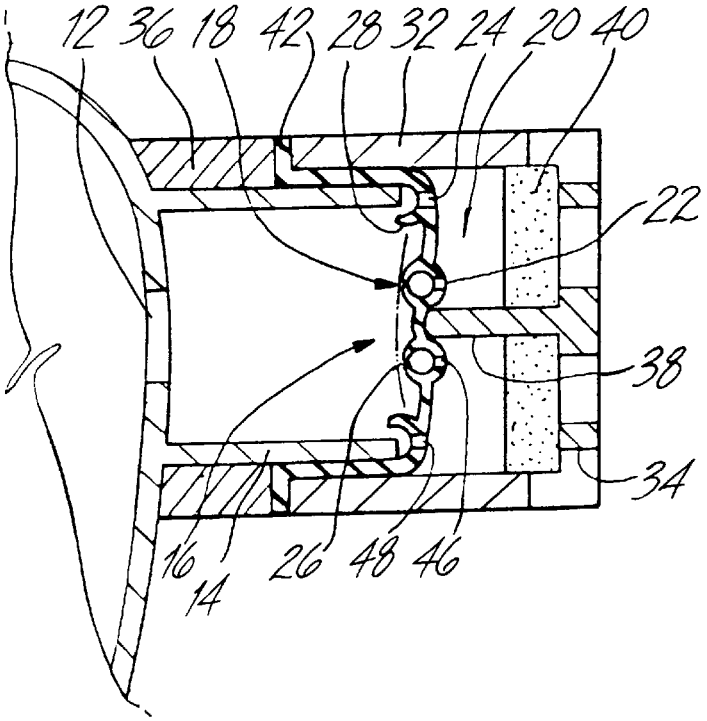
FIG. 5 is a cross-sectional view illustrating an intake mode of the device of the present invention, in which the elastic valve member is in an intake position.

Referring to FIG. 2, there is illustrated a cross-sectional view showing a construction of a device for removing moisture in a head lamp in accordance with an embodiment of the present invention; FIG. 3 is a front view showing an external appearance of a covering member used in the device for removing moisture in a head lamp of FIG. 2; FIG. 4 is a cross-sectional view illustrating an exhaust mode of the device of the present invention, in which an elastic valve member is in an exhaust position; and FIG. 5 is a cross-sectional view illustrating an intake mode of the device of the present invention, in which the elastic valve member is in an intake position.

A device for removing moisture in a head lamp according to the present invention includes a head lamp housing 10, an elastic valve member 16, a covering member 32 and a sponge 40.

A head lamp lens 30 is fitted to a front end portion of the head lamp housing 10, which is opened to the outside. A bulb and a reflector (not shown) are provided in the head lamp housing 10. An air vent hole 12 is formed in a rear end wall of the head lamp housing 10 to exhaust heat generated in the head lamp housing 10 when the head lamp is turned on. A pipe portion 14 is integrally formed with the rear end wall of the head lamp housing 10, which defines the air vent hole 12.

The elastic valve member 16 is fitted around an outer surface of the pipe portion 14. The elastic valve member 16 has a first cup-shaped configuration. A bottom wall portion of the elastic valve member 16, that is, a valve section 44 which is arranged in a path through which air can flow, has a shape that is curved toward the head lamp housing 10. The valve section 44 is formed with an intake valve 18 and an exhaust valve 20. The intake valve 18 is provided in substantially a center portion of the valve section 44, and the exhaust valve 20 is provided in substantially an edge portion of the valve section 44.

A first depression 46 is formed in a portion of the elastic valve member 16, which defines the intake valve 18. The first depression 46 is depressed in a direction opposed to the head lamp housing 10 and circumferentially extends. A plurality of air intake holes 22 are formed in the first depression 46 in such a manner that they are spaced from one another. Also, a pair of first elastic lips 26 are formed in a portion of the elastic valve member 16, which defines a neck of the first depression 46. The pair of first elastic lips 26 face to each other while circumferentially extended. If the pair of first elastic lips 26 are engaged with each other, air cannot flow through the plurality of air intake holes 22, and if the pair of first elastic lips 26 are disengaged from each other, an air can flow through the plurality of air intake holes 22.

A second depression 48 is formed in a portion of the elastic valve member 16, which defines the exhaust valve 20. The second depression 48 is also depressed in a direction opposed to the head lamp housing 10 and circumferentially extends. A plurality of air exhaust holes 24 are formed in the second depression 48 in such a manner that they are spaced from one another. A second elastic lip 28 is formed in a portion of the elastic valve member 16, which defines a neck of the second depression 48. The second elastic lip 28 can be engaged onto an inner surface of the pipe portion 14. If the second elastic lip 28 is engaged onto the inner surface of the pipe portion 14, air cannot flow through the plurality of air exhaust holes 24, and if the second elastic lip 28 is disengaged from the inner surface of the pipe portion 14, air can flow through the plurality of air exhaust holes 24.

The covering member 32 having a second cup-shaped configuration is fitted onto a circumferential outer surface of a cylindrical wall portion of the elastic valve member 16. A plurality of stopper projections 36 are integrally formed on a circumferential outer surface of the pipe portion 14 such that they are spaced with each other in a circumferential direction. A flange portion 42 which is formed to an end of the elastic valve member 16 is sandwiched between an end of the covering member 32 and the plurality of stopper projections 36. Therefore, the elastic valve member 16 can be held in a firmly clamped state. A grill 34 is formed in a bottom wall portion of the covering member 32 to allow air to be passed therethrough. Then, the sponge 40 is attached to the bottom wall portion of the covering member 32. The sponge 40 functions to first prevent outside moisture from flowing into the head lamp housing 10 through the covering member 32.

Hereinafter, an operation of the device for removing moisture in a head lamp, constructed as mentioned above, will be fully explained.

While the head lamp is turned on, a temperature in the head lamp housing 10 is elevated, and a pressure in the head lamp housing 10 is also elevated. If the pressure in the head lamp housing 10 is larger than a first reference value, the second elastic lip 28 formed in the exhaust valve 20 is disengaged from the inner surface of the pipe portion 14 by an action of a high pressure developed in the head lamp housing 10. Accordingly, air in the head lamp housing 10, having a high temperature and a high pressure, is exhausted through the plurality of air exhaust holes 24. At the same time, moisture formed in an inner surface of the covering member 32 which has a lower temperature than a center portion thereof because its outer surface is contacted with outside air, is vaporized by the air of high temperature and exhausted to the outside together with the air in the head lamp housing 10. As the air is exhausted to the outside, a pressure in the head lamp housing 10 is gradually lowered. In this situation, if the pressure in the head lamp housing 10 is lower than the first reference value, the exhaust valve 20 is automatically closed.

While the head lamp is turned on, the opening or closing operation of the exhaust valve 20 is alternately repeated to exhaust the air of high temperature and high pressure to the outside. When the air of high temperature and high pressure flows toward the exhaust valve 20 in the head lamp housing 10, it dries and heats a portion of the intake valve 18 before it is exhausted to the outside through the exhaust valve 20.

When the head lamp is turned off, a temperature in the head lamp housing 10 is lowered, and a pressure in the head lamp housing 10 is also lowered. If the pressure in the head lamp housing 10 is lower than a second reference value, the pair of first lips 26 formed in the intake valve 18 are disengaged from each other by an action of an atmospheric pressure outside the elastic valve member 16. Accordingly, outside air flows into the head lamp housing 10 through the plurality of intake holes 22. At this time, when a pressure in the head lamp housing 10 is larger than the second reference value, the intake valve 18 is automatically closed. Therefore, the intake valve 18 can be held in an opened state for only a short time.

While the head lamp is turned off, the opening or closing operation of the intake valve 18 is alternately repeated to intake outside air into the head lamp housing 10. Also, it is to be readily understood that when the outside air flows into the head lamp housing 10, moisture contained in the outside air is effectively removed by a heat of the portion of the intake valve 18 heated during the exhausting process.

If the head lamp is not used, the intake valve 18 and the exhaust valve 20 are maintained in a closed state, and therefore, the outside air cannot flow into the head lamp housing 10.

A drawing reference numeral 38 designates a pin portion which is integrally formed with the bottom wall portion of the covering member 32. The pin portion 38 functions to limit a deformation of the elastic valve member 16, when the air of high temperature and high pressure is exhausted to the outside through the exhaust valve 20. In the preferred embodiment of the present invention, the elastic valve member 16 is made from rubber.

According to the device for removing moisture in a head lamp of the present invention, when a pressure in a head lamp housing is elevated while the head lamp is turned on, an exhaust valve is opened to exhaust air in the head lamp housing to the outside, and when a pressure in the head lamp housing is lowered as the head lamp is turned off, an intake valve is opened to intake outside air into the head lamp housing. A space inside the head lamp housing is maintained in a tightly closed state while the head lamp is not used. Also, air which exhausted to the outside when the head lamp is turned on, vaporizes moisture formed in an inner surface of a pipe portion, and moisture contained in outside air flowing into the head lamp housing is removed by a heat of a portion of the intake valve. Therefore, since moisture in the head lamp is effectively exhausted and only a small amount of outside moisture can flow into the head lamp, the head lamp cannot be frosted with moisture, whereby an illumination intensity of the head lamp is increased and a valuableness of an automobile is enhanced.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A device for removing moisture in a head lamp, comprising:

a head lamp housing having an air vent hole; and an elastic valve member fixed to a wall portion of the head lamp housing, which defines the air vent hole, the elastic valve member having an exhaust valve for allowing air in the head lamp housing to be exhausted to an outside as a pressure of air in the head lamp housing is increased and an intake valve for allowing outside air to flow into the head lamp housing as the pressure of air in the head lamp housing is decreased.

2. A device for removing moisture in a head lamp as claimed in claim 1, wherein a pipe portion is integrally formed with the wall portion of the head lamp housing, which defines the air vent hole, and the elastic valve member is fitted around an outer surface of the pipe portion.

3. A device for removing moisture in a head lamp as claimed in claims 2, wherein a valve section of the elastic valve member, which is arranged in an air flowing path, has a shape that is curved toward the head lamp housing.

4. A device for removing moisture in a head lamp as claimed in claim 3, wherein the intake valve is provided in substantially a center portion of the valve section of the elastic valve member, and the exhaust valve is provided in substantially an edge portion of the valve section of the elastic valve member.

5. A device for removing moisture in a head lamp as claimed in claims 1 or 4, wherein a first depression is formed in a portion of the elastic valve member, which defines the intake valve, the first depression being depressed in a direction opposed to the head lamp housing and circumferentially extending; a plurality of air intake holes are formed in the first depression such that they are spaced from one another; and a pair of first elastic lips are formed in a portion of the elastic valve member, which defines a neck of the first depression, the pair of first elastic lips facing to each other while circumferentially extending and being capable of closing the plurality of air intake holes when engaged with each other.

6. A device for removing moisture in a head lamp as claimed in claim 4, wherein a second depression is formed in a portion of the elastic valve member, which defines the exhaust valve, the second depression being depressed in a direction opposed to the head lamp housing and circumferentially extending; a plurality of air exhaust holes are formed in the second depression such that they are spaced from one another; and a second elastic lip is formed in a portion of the elastic valve member, which defines a neck of the second depression, the second elastic lip circumferentially extending and being capable of closing the plurality of air exhaust holes when engaged to an inner surface of the pipe portion.

7. A device for removing moisture in a head lamp as claimed in claim 2, further comprising:

a covering member having a cup-shaped configuration and fitted around an outer surface of the elastic valve member, the covering member having a grill formed in a bottom wall portion thereof.

8. A device for removing moisture in a head lamp as claimed in claim 7, further comprising:

a sponge attached to the bottom wall portion of the covering member.

9. A device for removing moisture in a head lamp as claimed in claim 7, wherein a pin portion is formed in a center portion of the bottom wall portion, the pin portion projectedly extending toward the head lamp housing to limit an amount of deformation of the elastic valve member; and a plurality of stoppers are formed on the outer surface of the pipe portion.

10. A device for removing moisture in a head lamp as claimed in claim 1, wherein the elastic valve member is made from rubber.

* * * * *